United States Patent [19]

Bijttebier

[11] 4,119,306

[45] Oct. 10, 1978

[54] METHOD AND APPARATUS FOR SEPARATING AND PROCESSING A PLURALITY OF SUPPLE SHEETS IN A SINGLE OPERATION

[76] Inventor: Gaspar A. Bijttebier, Grote Heerweg, 64, B-8749 Beveren-Leie, Belgium

[21] Appl. No.: 750,815

[22] Filed: Dec. 15, 1976

[30] Foreign Application Priority Data

Dec. 16, 1975 [BE] Belgium ..... 17082
Jul. 29, 1976 [NL] Netherlands ..... 7608456

[51] Int. Cl.[2] ..... B65H 39/05

[52] U.S. Cl. ..... 270/58; 156/563; 270/82

[58] Field of Search ..... 270/58; 271/11, 14, 271/18.3, 30 R, 118; 214/6 G, 6 F, 6 IS, 6 R, 8.5 R, 8.5 D, 8.5 A, 8.5 SS, 6 DK, 6 M, 6 FS, 6 TS; 156/556–557, 559, 563, 565

[56] References Cited

U.S. PATENT DOCUMENTS 3,330,555 7/1967 Shearer ..... 271/30 R
3,940,125 2/1976 Morton ..... 271/18.3

*Primary Examiner*—Edgar S. Burr
*Assistant Examiner*—A. Heinz
*Attorney, Agent, or Firm*—Shlesinger, Arkwright, Garvey & Dinsmore

[57] ABSTRACT

A method and apparatus for simultaneously separating one sheet from each of several stacks and removing the separated sheets to a desired position wherein the sheets are picked up from superimposed stacks lying on a plurality of tables by means of several sets of pick-up devices, whereby successively the several tables with stacks of sheets are raised into contact with the pick-up devices positioned over them and subsequently picked up, the tables are then lowered away from the pick-up devices so as to separate the engaged and tightened sheets from their respective underlying stacks, supporting means for the sheets are slid between each separated sheet and its stack, the sheets are disengaged from the pick-up devices and dropped on the supporting means, and the supporting means are then moved horizontally from beneath the pick-up devices and superimposed vertically. The sheets are then engaged and simultaneously removed from their respective supporting means in a stacked relationship.

17 Claims, 15 Drawing Figures

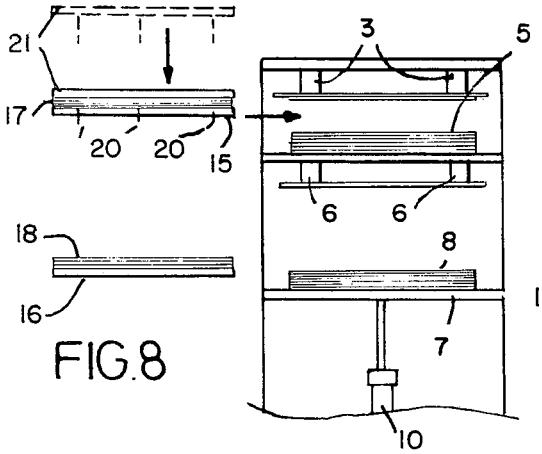
FIG.8
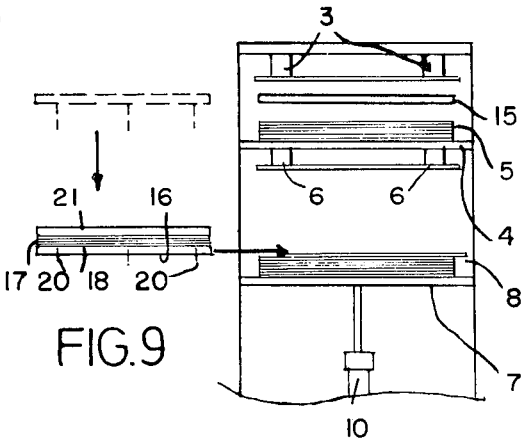
FIG.9
FIG.10
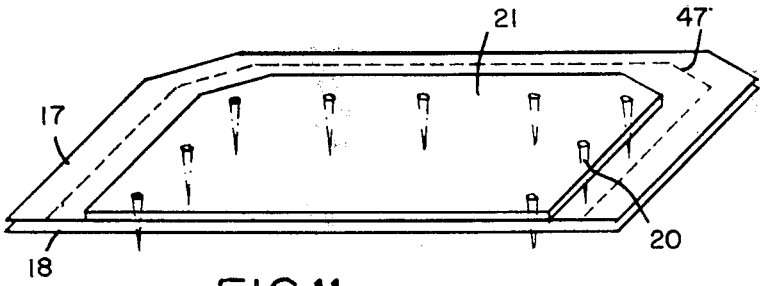
FIG.11
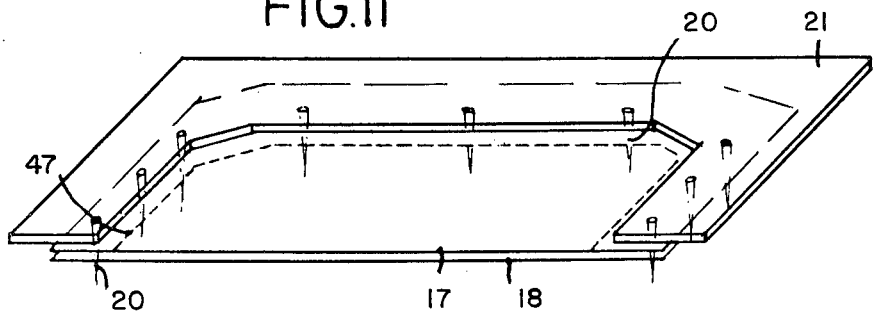

FIG.14
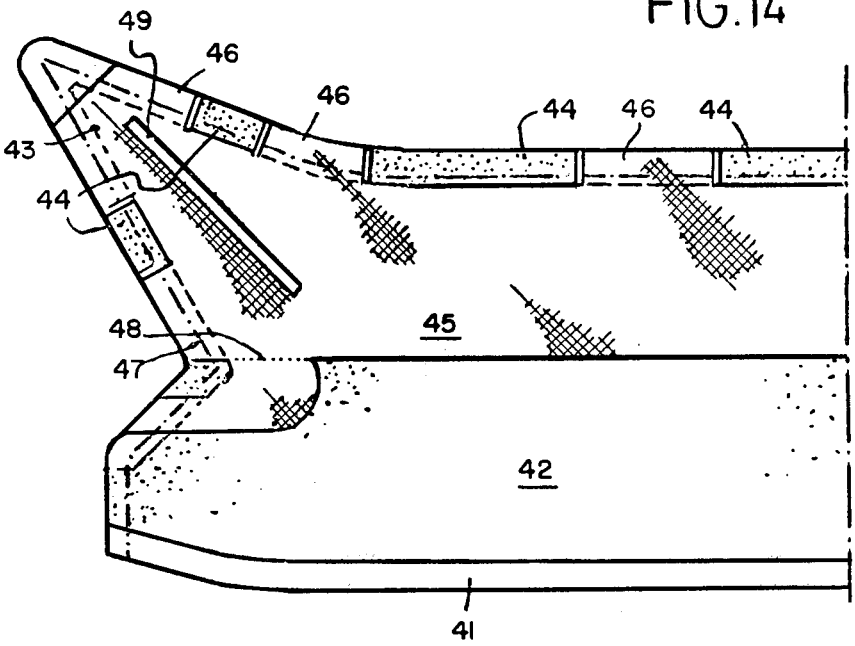
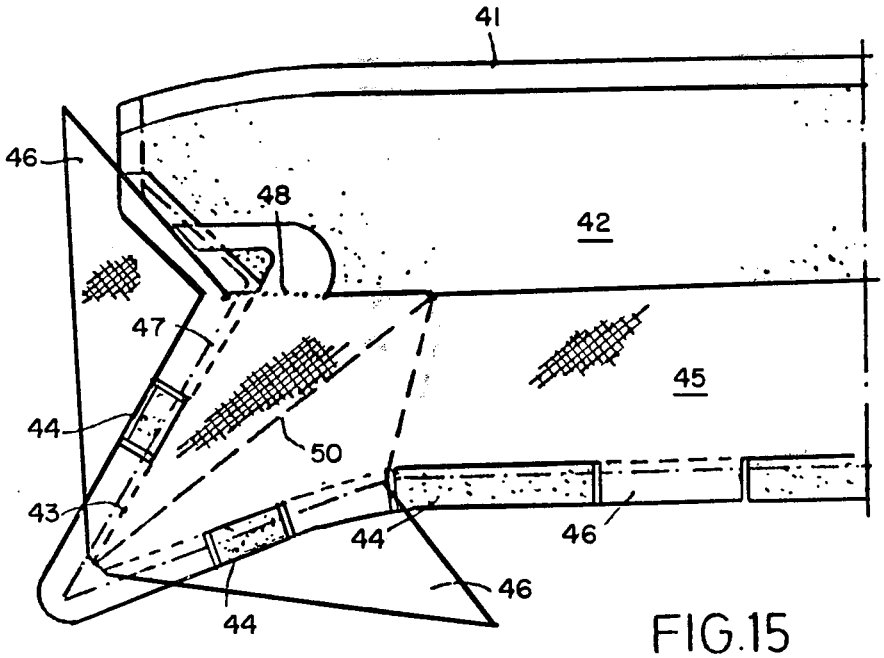
FIG.15

METHOD AND APPARATUS FOR SEPARATING AND PROCESSING A PLURALITY OF SUPPLE SHEETS IN A SINGLE OPERATION

BACKGROUND OF THE INVENTION

This invention relates to an improved method and apparatus for automatically separating and processing supple sheets from several stacks in a single operation whereby use is made of separating elements, more particularly pick-up heads, as illustrated in Belgian Pat. No. 816,940 or U.S. Pat. No. 3,981,495, the latter patent being expressly incorporated by reference.

Said Belgian patent describes a universal automatic apparatus for separating supple sheets from stacks, which apparatus is made of a rigid frame comprising adjustable transverse rods to which universal separating elements with special pick-up heads are adjustably attached, and whereby the pick-up heads are disposed with a suitable orientation over the corners or edges of the stacks. The separating process with this universal apparatus is as follows:

The stack is compressed by means of the separating elements in the civinity of a pair of opposite upper edges of the stack. In order to pick up the sheet, sharp projections engage the sheet near its edges. These projections are fixed to the underside of a pricking element that is rotatably mounted in the pickup head. Subsequently, the projections are laterally moved apart over a sufficient distance, whereby the engaged sheet is tightened and whereby finally the separating elements with the engaged and tightened sheet are moved away from the stack. Means are also provided to synchronize the up-and-down movement and the application of pressure on the stack by the pick-up heads, as well as the picking and tightening movements of the picking devices that are rotatably bearing-mounted in the pick-up heads.

Furthermore, on page 11 of the Belgian Pat. No. 816,940 of Applicant, it is also suggested to mount one or more of such separating apparatus over an intermittently progressing conveyer belt, so that in a suitable manner several stacks can be formed and/or removed sheet by sheet. It is also described in FIGS. 16 to 18 of the Belgian Pat. No. 806,540 that with the same separating elements it is possible to successively pick up one sheet from a first stack, next to deposit this sheet onto a second stack, and finally to pick up at least two sheets from this second stack by means of needles with a suitable projecting length.

Both processes however have two important disadvantages. The whole process involves a sequence of movements of the separating elements and the stacks which is complicated, extensive, inconvenient to operate, slow, unstable and consequently hard to control accurately. Another disadvantage is a result of the fact that directly depositing a separated sheet onto another sheet or onto a stack of such sheets by means of the formerly patented separating ellements is difficult to carry out accurately. Indeed, the underlying sheet or stack, is too uneven (rough surface, hairy, etc.) and often too deformable to place a new sheet thereon, so that the latter may shift, or locally be pulled out of alignment in an uncontrollable manner, or lies in wrinkles instead of flat. When depositing the tightened sheet and retracting the pricking elements, the sheet will slightly contract. Due to frictional contact with the underlying sheet, the latter, which is in untightened condition, may also undesirably contract and become wrinkled.

The invention now provides means whereby both disadvantages are simultaneously avoided by applying an improved process and apparatus for automatically and simultaneously separating sheets from several stacks and further depositing the engaged sheets in an accurate position, whereby said sheets are picked from superimposes stacks (instead of stacks placed side-by-side as formerly proposed) by means of several groups of separating elements, more particularly pick-up heads of the type described in the Belgian Pat. No. 816,940. More particularly, the invention provides means to place the picked sheets accurately one on top of the other in a suitable relative position.

Indeed, when sheets, for example size cut textiles in readymade clothing factories, are to be fed from stacks that come from the cutting tables to, for example, stitching machines for sewing on buttons and making buttonholes and hems or the like, then it is an essential requirement that the sheets arrive at the feeding mechanism in front of the stitching head in a correct position and orientation. Also when, for example, two sheets are to be automatically stitched together, both the positioning of the sheets on each other and the position and orientation of the combination of the sheet layers relative to the stitching head must be faultless in order to produce accurate and impeccable automatic stitching work.

The different superimposed tables on which stacks of sheets are placed are for that purpose in a first process brought by vertical translation into contact with the sets of pick-up devices that are properly disposed between or over them. The sheets are picked up and the tables with sheet stacks are again moved away from each other in the vertical direction to separate the engaged and tightened sheets from the immediately underlying stacks. Next, supporting means for these sheets are slid between each engaged sheet and the stack immediately underneath. The sheets are then disengaged from the sets of pick-up devices, so that they drop on the supporting means underneath and are removed horizontally from beneath the pick-up heads and possibly fed to the feeding mechanisms of the stitching machines.

When it is intended to place the separated sheets on each other, in a suitable relative position, then the removed supporting means with the sheets thereon are brought together by vertical translation, whereby at the same time these removed sheets are mutually connected in places located one above the other through suitable apertures in the supporting means. Finally the mutually connected sheets are removed from between the supporting means and supplied to the feeding mechanisms of the stitching machines or to the operator.

The improved automatic apparatus for carrying out these processes comprises a framecomposed of a number of vertical edge supports that are, among other things, mutually connected at their upper ends by suitable transverse sections. A number of pick-up heads are fixed to the underside of these uppermost transverse section. Between the vertical supporting sections, vertically movable horizontal tables are disposed, whose undersides are also provided with adapted sets of pick-up heads. At the underside of the bottommost table, pressure means are provided for moving the tables up and down. The apparatus further comprises horizontal supporting means, for example plates for the sheets separated by the pick-up heads, as well as means for inserting in a suitable manner said supporting means between the sets of pick-up heads and the immediately underlying stacks for removing the supporting means from between the pick-up heads and the stacks and for feeding them to, for example, the feeding mechanisms of stitching machines.

When the separated sheets are to be placed one on the other, the apparatus is further equipped with means for bringing together the removed supporting means with the sheets on them and for simultaneously mutually connecting the sheets in places located one above the other through suitable apertures in said supporting means. It is obvious that these joining and connecting means are so made that they permit automatic removal of the mutually connected sheets from between the supporting means and to feed them to stitching machines.

DESCRIPTION OF THE DRAWINGS

An embodiment and the working of the apparatus according the invention and the associated possibilities and advantages will now be further clarified, whereby reference is made to the accompanying drawings, in which:

FIGS. 8 and 9 illustrate another arrangement of the assembling operation of the sheets.

FIGS. 10 and 11 are perspective views of the assembled sheets hanging at the assembling plate.

FIGS. 14 and 15 show an example of a simplified collar construction adapted to the process and apparatus according to the invention.

DESCRIPTION OF THE INVENTION

Figure 1:
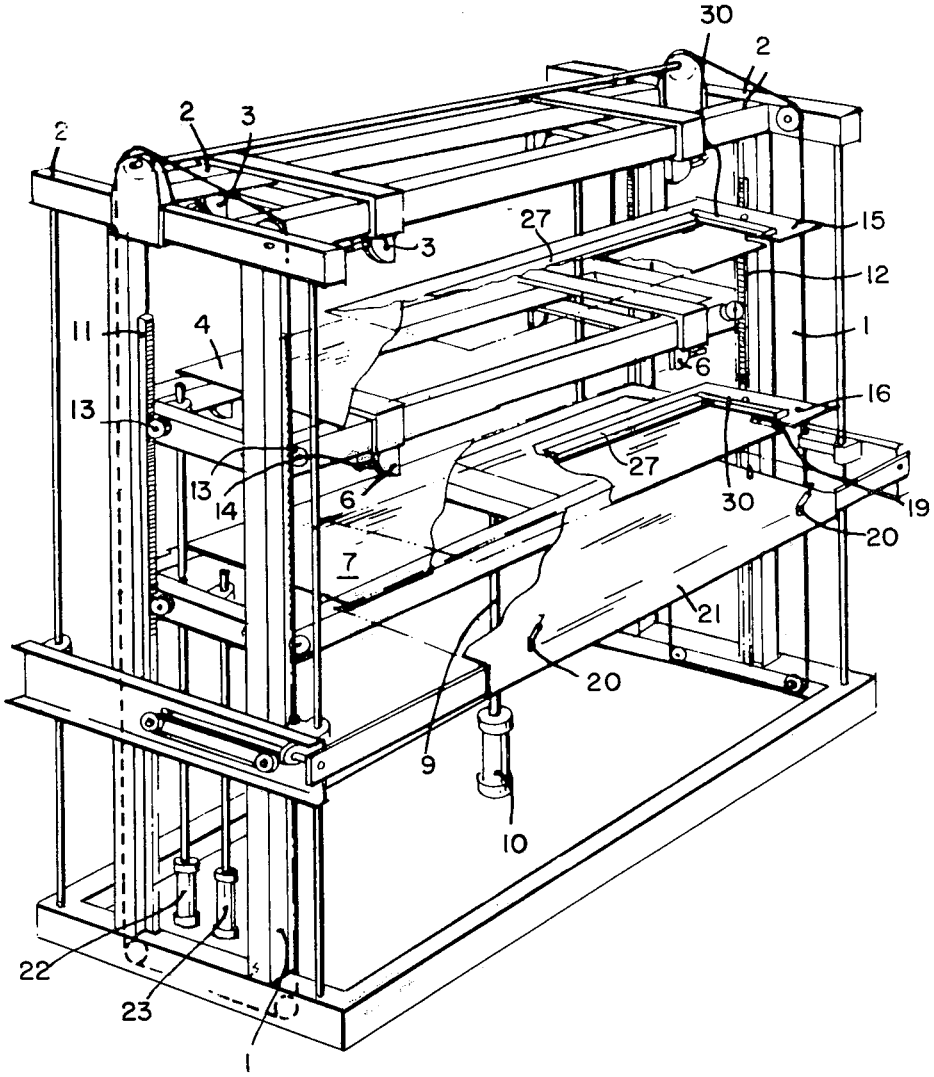
FIG. 1 is a perspective view of an apparatus for placing two separated sheets one on top of the other.

The apparatus shown in FIG. 1 comprises a rigid frame composed of some four vertical edge sections 1, which are mutually connected by suitable transverse sections 2. At the undersides of the uppermost transvese sections, a number of pick-up heads 3 of the type described in the Belgian Pat. No. 816,940 are provided in such a way that they are located perpendicularly over the edges or corners of the sheet stack 5 lying on the table 4. To the underside of table 4 pick-up heads 6 are also fixed in the same manner, whereas to the underside of the bottommost table 7, on which also lies a stack of sheets 8, a piston rod 9 of the pressure cylinder 10 is attached. To each angular section, toothed beams 11, 12 are fixed meshing with the gear wheels 13, of which the shafts 5 rotate in bearings that are connected to the undersides of table 4, respectively 7. Said toothed beams with the enmeshing gear wheels offer a perfectly horizontal position of all vertical levels during the up-and-down movement of the tables, the opposite toothed wheels always being fixed to the same shafts. The pick-up operation of the separating elements is pneumatically controlled by means of pressure cylinders 14. In the supporting means 15 and 16 for the separated sheets 17 and 18, respectively, suitable apertures are provided as passages for the connecting means 20 (for example needles) on the assembling plate 21, whose function it is to bring together the separated supporting means 15 and 16, as described hereafter.

As compared with the formerly proposed separating apparatus, the entire construction is less intricate, offers greater stability, and separate pressure cylinders for each head are no longer necessary. One central pressure cylinder 10 may suffice to carry out any number of separating movements at the same time. Formerly, if from $n$ juxtaposed equal stacks one sheet was to be separated simultaneously, a total force $n\ (p-k)$ was to be applied, where $p$ is the necessary total pressure force applied by the separating elements per stack and $k$ the weight of the separating elements per stack. With the superposition of the stacks according to the invention, only a force $p + q$ is necessary, where $q$ indicates the force needed for lifting the movable tables to which the separating elements are fixed and on which the stacks are lying. When it is considered that $p$ may vary between 100 and 200 kg; then one readily sees that the solution according to the invention requires much less energy:

$$n\ (p-k) > p + q.$$

Since the pick-up heads per stack are now directly fixed to a single overlying table, synchronization of the movement is strongly simplified and may be made with greater precision. The gain in space and the simplicity of the construction obviously also favor the convenience of operation, so that one operator may now easily look after several separating machines.

Figure 2:
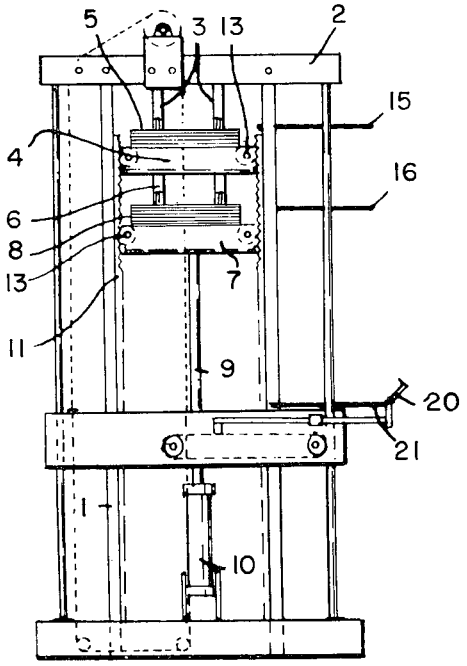
FIGS. 2 to 6 are schematic illustrations of the successive steps from the engagement to the removal of two mutually connected sheets from between the supporting means.
Figure 3:
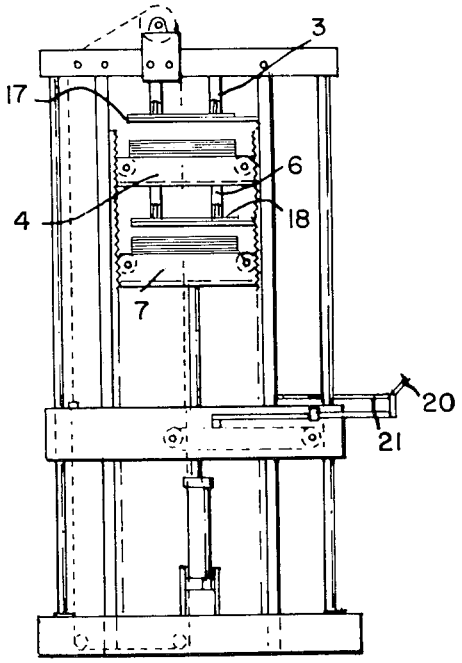

A first step in the working cycle of the apparatus is shown in FIG. 2. The pressure rod 9 has pushed the tables 4 and 7 with the stacks 5 and 8 against the pick-up heads 3 and 6. A suited pressure impulse in the cylinders 14 starts the pick-up process of the pick-up heads 3 and 6; each (not shown) pick-up device rotates around the axis of its shaft (34 and 35), so that the uppermost sheet is engaged by the needle points 36 and tightened. The pressure in the cylinder 10 is released and the tables are brought down in a controlled manner to the required level by means of the pressure cylinder 22 for the table 4 and the cylinder 23 for the table 7. Reference will be made to this again in the description of FIG. 7. The engaged sheets 17 and 18 now stick to the pick-up heads 3 and 6, as shown in FIG. 3, and the supporting plates 15 and 16 on rods 15' and 16' can be slid under the respective sheets. The pick-up devices in the pick-up heads can be retracted by means of a suitable spring release in the heads (see FIG. 12), so that the sheet is released and falls onto the plate. When sheets with relatively large dimensions are to be separated, it is sometimes preferable to bring the supporting plates 15, 16, after being slid between the separated sheets and the stack immediately underneath, in contact with the sheets still engaged by the separating elements, whereafter the pick-up heads release the sheets and the supporting means with the sheets lying thereon are lowered to their introduction level prior to being removed in the horizontal direction from between the stacks.

Figure 4:
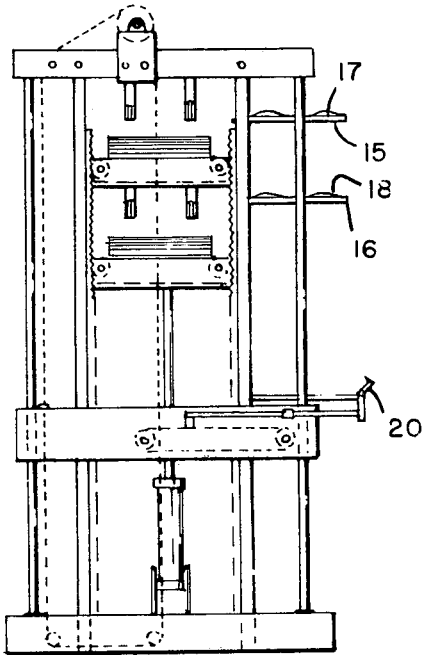

In the next stage as shown in FIG. 4, the plates 15 and 16 are removed from between the stacks. This movement takes preferably place simultaneously for all sheets and must be done without jolts. Therefore it is desirable to start and stop the plates 15 and 16 gradually in order avoid uncontrolled shifting of the sheets on the plates during the lateral movement.

Figure 5:
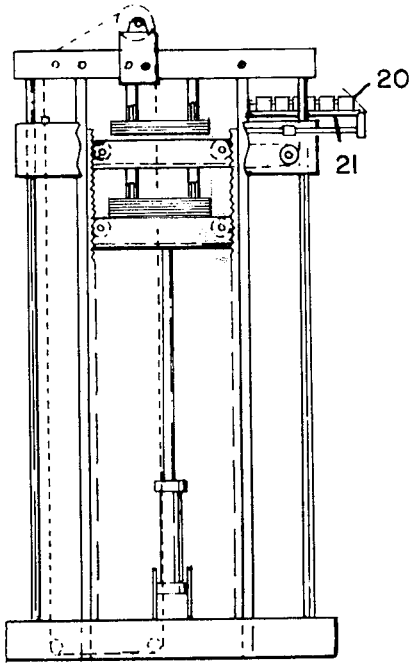

Further, as illustrated in FIG. 5, the plates 15 and 16 with the sheets 17 and 18 lying on them, are brought together by an upward movement of the plate 21 between rods 15′ —15′ and 16′ —16′ and controlled by the chain 29. Here the needles 20 pierce the sheets 18 and 17 through the apertures 19 in the plates 15 and 16, so that these sheets are locally mutually connected. In the meantime, the tables with the stacks are again pushed upwards against the respective sets of pick-up heads so that a second separating cycle starts.

Figure 6:
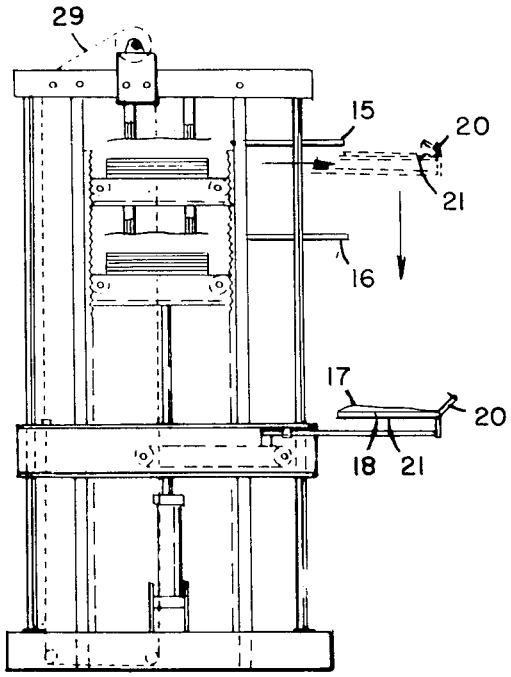

Next, the assembling plate 21 with the sheets connected thereto by means of needles 20 is removed from under the plates 15 and 16 (FIG. 6); these plates return to their position in FIG. 2 and the tables again descend to the level of FIG. 3, whereby again a sheet is retained by the sets of pick-up heads. At the same time, the plate 21 also descends and the needles 20 are disengaged from the accurately stacked sheets 17 and 18 so that the latter can be removed from plate 21, either manually or mechanically. In order to prevent hitching of the sheets on the needle points 20 when disengaging the latter from the sheets, it is possible to provide in the immediate vicinity of needle 20 a springing body which extends when extracting the needles and thus helps disengage the sheets from the needle points.

Figure 7:
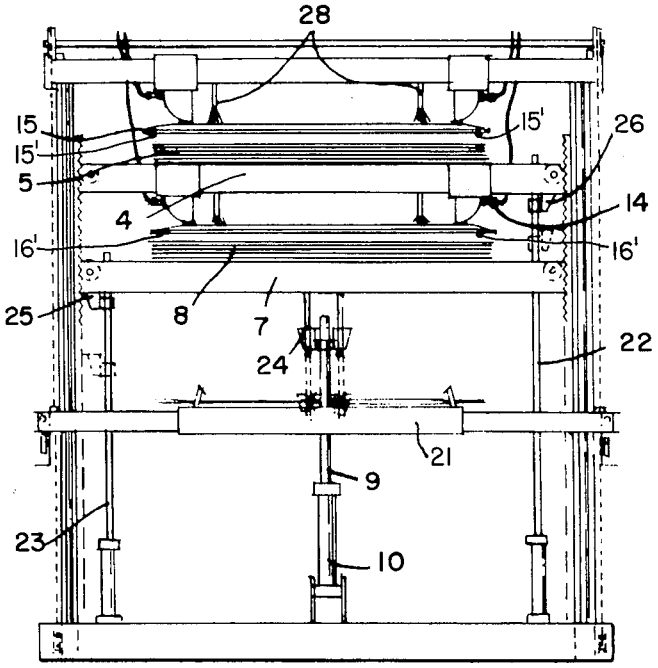
FIG. 7 is a front view of the apparatus.

The front view of FIG. 7 illustrates a few additional characteristics of the apparatus according to the invention. First there are the pressure cylinders with rods 22 and 23, which regulate the downward movement of the tables. As successive sheets are removed from the stacks, the free space between the stacks and the pick-up heads increases if each time the tables are allowed to come down to the same low level as necessary for large stacks. The distance or travel of the vertical movement of the tables increases as the stacks get smaller and thus increasingly unnecessary distances are being travelled by the pressure rods and tables. This can be remedied by providing the rods with gripping elements 24, 25, 26 that are attached to the undersides of the tables. The minimum required distance between the undersides of the pick-up heads and the uppersides of the immediately underlying (uncompressed) stack must be selected so that a supporting plate 15, 16 can be slid in between unobstructedly. This distance is equal to *a*.

The gripping systems 25, 25, 16 are so made that they can only slide upwards on the pressure rod and whenever they tend to slide downwards they clamp to this rod as in a jack system.

The travel of the rod 22 will have to be slightly greater than *a*, whereas rods 23 and 9 will need a travel slightly exceeding 2*a* in order to provide compression for any stack thickness. As the stacks get smaller, the aforementioned clamps will grip progressively higher on the rods, which higher distance always corresponds with the reduction in stack thickness 5 and 8 for the rods 9 and 23. The clamps 25 and 26 each time grip in a higher position at the end of the compression applied by rod 9, whereas clamp 24 will grip in a higher position at the end of the descent of the rod 9.

As shown in FIG. 8, the assembling plate 21 with downwardly extending needles 20 for assembling the sheets can also be arranged near the level of the uppermost pick-up heads 3. Assembly of the sheets can then be performed by lowering plate 21 to the position illustrated in FIG. 8 thereby piercing the sheet 17 by the needles 20 which extend throughout suitable slots in the supporting plate 15. This plate 15 is subsequently horizontally translated in the pile direction between heads 3 and stack 5 (see FIG. 9) and the plate 21 is further lowered to pierce sheet 18. Plate 16 which is again provided with suitable slots is finally translated to its position between heads 6 and stack 8.

A perspective view of possible shapes of the plate 21 is shown in FIGS. 10 and 11. The dotted line 47 indicates the stitching seam and it is clear from FIGS. 10 and 11 that the outer and inner edges of plate 21 serve as a guide for the stitching head to make the appropriate stitching line.

Another additional characteristic relates to the possibility of an exact positioning of the deposited sheets 17 and on the supporting plates 15 and 16. Indeed, it may be that the sheets in the different stacks are not always lying in the same accurate position. These differences in position must however be eliminated when the separated sheets arrive at the stitching machines. Therefore the sheets 15 and 16 may be provided with suitably oriented position stops 27 and 30 against which certain sheet edges can be slid by means of positioning means 28 that rest on the separated sheet during the removal of the plates with the sheets lying on the. To carry out this positioning movement carefully, it is also preferable to remove the plates, particularly at the start, without shocks.

Suitable positioning means include among other things, brushes 28 with adjustable weight, which are mounted between the pick-up heads and which are pneumatically lifted when the tables are being brought together. While the picked sheet is being deposited onto the plates 15, 16, the brushes are lowered onto the sheet surface. When the plate with the sheet is being removed, they move the sheet on the plate by friction contact with the sheet surface until the sheet edges touch the stop 27. The frictional force between the brushes and the sheet surface must of course be higher than the frictional force between the sheet and the supporting plate, but must not tend to fold the sheet against the stop. Hence it is important that the weight and/or number of brushes be varied according to the circumstances and that their distance from the sheet edge be kept small. The above described feature relating to the slow starting of the lateral movement of the supporting plates 15 and 16 also permits certain brushes during a brief period to follow a path perpendicular to this direction in order to achieve correct positioning against the stop 30. Thus a correct predetermined positioning of the sheet on the plate in the two directions is obtained (stop 27 and stop 30). Finally, the brushes are again pneumatically lifted.

Surprisingly, it has also been determined that the deposited sheet can be slid against the position stop 27, 30 on the plates 15, 16 by allowing the plate to vibrate horizontally in a suitable manner. Therefore, pneumatically operated vibrating elements can be mounted on the supporting frame of the plate, for example near the edges of the plate. During each vibration period the plates are submitted to a slow shift in the direction corresponding to the desired positioning stops and a rapid shift in the opposite direction. During the rapid shift, the smooth plate slides under the sheet since the kinetic intertia of the sheet is superior to the frictional force between the sheet and the plate. During slow movement of the plate in the opposite direction, the sheet follows the movement of the plate since the frictional forces now exceed the inertial forces of the sheet. This vibration action causes any wrinkles in the sheet to be shaken out. When the sheet lies in an oblique position relative to the stop and consequently does not approach it in parallel relationship during the vibration, then as a result of the vibration, the sheet starts to turn on the plate around the first contact area between the sheet and the stop until the sheet edge forms the desired line contact with the positioning stop. The positioning process continues after the plates have been removed from between the stacks.

The horizontal vibration process can also be carried out as follows: the smooth plate with the sheet on it is moved with progressively increasing speed in the desired direction for the sheet and is abruptly stopped against the stop on the supporting frame. This movement may for example be achieved by means of a spring action. The spring is on the one hand attached to the supporting frame, which suddenly moves in the desired direction, and on the other hand to the plate. The sheet moves with the plate, but because of its inertia it continues to move towards the positioning stop 27, 30 when the plate is abruptly stopped against its own stop on the supporting frame. If desired, this process may be repeated a few times. After this first movement, a number of springloaded horizontal vibrations with a frequency of, for example, 2 cycles per second can be applied to obtain a more accurate positioning against the stops 30 and 27.

It is obvious that by adjusting the direction, duration, amplitude and frequency of the vibrations, any desirable movement can be achieved. For example, it may be desirable to reduce the vibration amplitude as the sheets to be positioned are either light or close to the positioning stop 27 and 30. If it is also intended to cause through vibration a rotation of the sheet edge, small amplitude vibration will be preferable.

Figure 12:
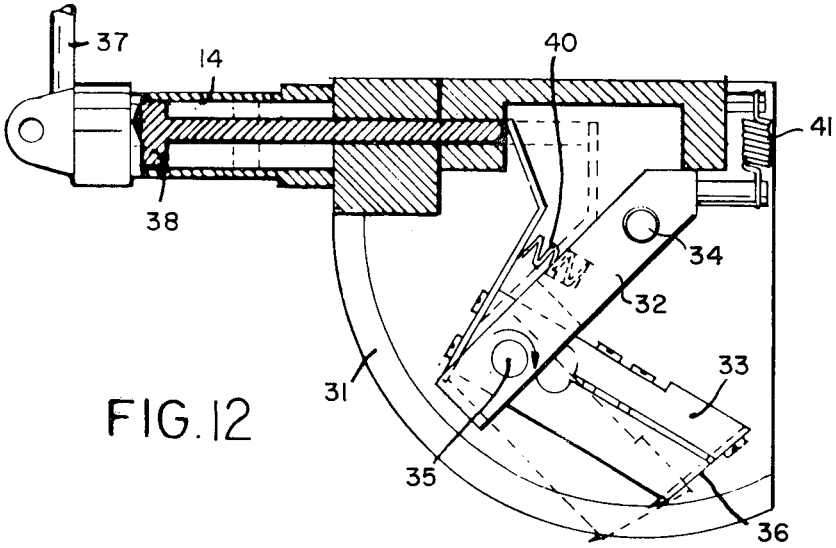
FIGS. 12 and 13 are views of the pick-up head.
Figure 13:
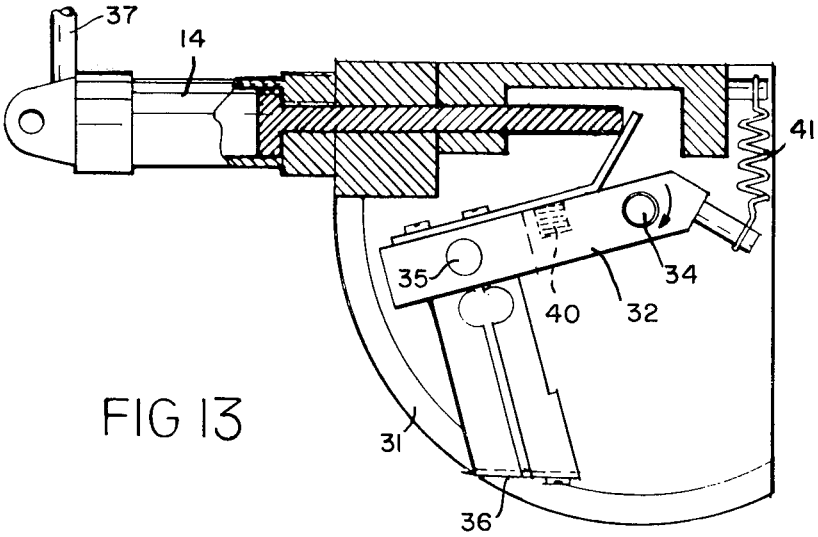

FIGS. 12 and 13 show two positions of the pick-up heads 3, 6. The embodiment is greatly simplified as compared with the type of pick-up heads illustrated in the aforementioned Belgian Pat. No. 816,940 of applicant; the operation however is completely analogous. The pressure shoes 31 now have a circular, rounded underside and the pick-up device now consists of two sections 32 and 33 which rotate about shafts 34 and 35 respectively. The needles 36 with adjustable projecting length are attached in the underside of the section 33. When increasing the pressure in the cylinder 14 through the supply pipe 37, the piston 38 with the pressure rod pushes back the lever arm 39 against the tension of the spring 40, so that the section 33 starts to rotate about its shaft 35 from its retracted position towards its pick-up position (dotted line in FIG. 12). When the pressure in the cylinder 14 further rises, the section 32 will start to rotate about its shaft 34 against the pressure of the spring 41 (FIG. 13). The shaft 34 also constitutes the center of the circular arc that borders the pressure shoe 31, so that the needle point is forced to follow this circular circumference.

Example

A shirt or blouse collar is produced by using an apparatus according the invention comprising four superimposed tables. A stack of sheets of collarsize cut shirt fabric lies on the bottommost table with the right side turned upwards. On the table above there is a similar stack, but with the right fabric side turned downwards. (In principle it is also possible to have the sheets with the right side turned upwards and after picking them up to turn them automatically, for example, during the removal of the sheets from between the stacks). On the table above it, there is a stack of collar-size cut basic lining sheets 42 and finally on the uppermost table there is a stack of hot-glueable, collar-size cut reinforcement sheets 45. Simultaneously the uppermost sheet is removed from each stack and deposited onto the supporting plate. The plates with the sheets are then removed from between the tables and horizontally vibrated to bring the sheets in the correct position. The supporting plates with the sheets are brought together by means of the plate 21, which feeds the sheets to the stitching machine as described above (FIG. 6).

The thus stitched collar appears as shown in the frontview of FIG. 14. An edge 41 of the sheets that lay on the two bottommost tables projects at the underside of the collar. The edge of the basic lining sheet 42 which lies thereon follows the dotted line 43, but this sheet also comprises crenellated parts. The reinforcement sheet 45 also comprises parts 46, which exactly fit in the intermediate spaces between these parts of sheet 42. The stitching seam 47 fixes both sheets 42 and 45 to the underlying collar sheets of shirt fabric in such a way that nowhere in the collar edge (prior to folding) there is a double (lining + reinforcing) fabric layer thickness. An appropriate choice of the location and dimensions of the crenellated projections 46, as suggested in FIG. 14, also contributes to an additional reinforcement effect of the collar edge point near the folding line 48 of the collar and without adding excessively to the thickness of the edges.

This collar concept is an example of adaptation of the collarmaking methods to automation requirements developed according to this invention. Formerly it was indeed necessary to fix the basic lining 42 and the hot-glueable reinforcement sheets 45 (both without crenellated projections) to the collar fabric by glueing before it was possible to stitch the collar edge (seam 47). It was also often necessary to provide the collar point areas with additional glueable reinforcement pieces. This invention however did not allow picking up of the small reinforcement pieces, and the complicated reinforcement process with separated pieces of fabric was efficiently substituted by the provision of projections 44 and 46. Furthermore, the invention offers the advantage that the ironing process can be postponed until after turning inside out of the collar edge that is stitched in seam 47 and until after applying the finishing seam near edge 47, which seam is located more to the inside. Turning inside out of the not yet stiffened whole is easier and the ironing of the turned and stitched collar also guarantees that the pressed sheets will stick together more readily into a wrinkleless laminate. Indeed, the effect of the heat is that during the glueing process there is also a thermofixation of the eventual shape in which they are forced by the ironing press. By the elimination of the collar point pieces, a saving in material is obviously obtained, but it is also possible that, as compared with the formerly used basic linings, lighter linings can now be used since the projections 44, 46 folded into the collar that is turned inside out increase sufficiently the strength near the collar edge, even with lighter basic linings. This considerable increase in strength then goes together with minimal edge thickening. The reinforcement sheet 45 is obviously provided with a stiffening rib 49.

It is also possible to make the reinforcement sheet 45 as illustrated in FIG. 15. The projecting edges 46 are made almost triangular in the collar point edge. When turning the collar inside out, the triangles are folded towards each other to be adjacent near the line 50. By applying this method, the function of the aforementioned additional collar point pieces has been taken over. The reinforcement sheet 45, which is preferably provided at both sides with a hot-glueable coating, can in this case also be made lighter: for example 150 g/m$^2$ instead of the current weight of 250 g/m$^2$. This also leads to material savings. Moreover, the triangular pieces 46 are largely located in the areas that are otherwise cut away as lost material. The shape of the triangles may for example be so adapted that they overlap in the collar near the line 50 in order to take over the function of the rib. It is also possible to incorporate the classic rib in a suitable manner in one of the triangular projections before folding.

While this invention has been described, it will be understood that it is not limited to the abovedescribed embodiment, whereby by way of example the automatic superimposing of two sheets of two different stacks is described. The apparatus may, for example, also be used to take one sheet simultaneously from several superimposed stacks, depositing each of these sheets onto a plate in the correct position and feeding them with the plate to a feeding mechanism of, for example, stitching machines. The removal of the different plates out of the separating apparatus may be done in any desired direction. Further modifications, either concerning the frame with the tables, the pressure cylinders and the rods, the supply and removal mechanisms of the plates and/or the positioning means for the sheets are considered as falling within the scope of the invention. This application is thus intended to cover any variations uses and/or adaptations of the invention following in general, the principles of the invention and including such departures from the present disclosure as come within known or customary practice in the art to which the invention pertains, and as may be applied to the essential features hereinbefore set forth, as fall within the scope of the invention or the limits of the claims.

What I claim is:

1. A method for simultaneously separating at least one sheet from each of a plurality of stacks of sheets, said stacks being positioned on tables vertically spaced one above the other, the method comprising:

(a) bringing said stacks into contact with sets of pick-up devices associated with each of said tables by vertical translation, (b) picking up at least one sheet from each of said stacks by means of said pick-up devices, (c) returning said tables and the associated stacks by vertical translation in the direction opposite to that of step a) and thereby separating each picked-up sheet from the underlying stack, (d) moving supporting members for each separated sheet between said sheet and the stack immediately therebeneath, (e) disengaging each separated sheet from the pick-up devices so that the sheets drop onto the associated supporting means therebeneath, and (f) horizontally removing the supporting means with the separated sheets thereon from beneath the pick-up devices to a desired position.

2. A method as in claim 1 and including bringing said separated sheets together after said horizontal removal step so that the removed sheets are mutually connected in places located immediately above each other through apertures in said supporting means.

3. A method according to claim 2 whereby during the removal of the supporting members with the sheets lying thereon, the sheets are deposited in the correct position on said members by means of shifting movements of the sheets against positioning stops provided on the supporting members.

4. A method according to claim 3 whereby the shifting movements are achieved by horizontal vibration of the supporting members.

5. A method according to claim 4 whereby during each vibration period, the supporting members are subjected to a slow shift in the direction corresponding to the desired shift of the sheet to be moved towards the positioning stops and a rapid shift in the opposite direction.

6. A method according to claim 1 whereby the supporting members after having been moved between the separated sheets and the immediately underlying stacks are brought into contact with the sheets still attached to said pick-up devices, whereafter said pick-up devices release the sheets and the supporting members with the sheets lying thereon are lowered to their previous level prior to being removed in the horizontal direction from between said pick-up devices and the stacks immediately therebeneath.

7. A method according to claim 6 whereby during the removal of the supporting members with the sheets lying thereon, the sheets are deposited in the correct position on said members by means of suitable shifting movements of the sheets against positioning stops provided on the supporting members.

8. A method according to claim 7 whereby the shifting movements are achieved by horizontal vibration of the supporting members.

9. A method according to claim 8 whereby during each vibration period the supporting members are subjected to a slow shift in the direction corresponding to the desired shift of the sheet to be moved towards the positioning stops and a rapid shift in the opposite direction.

10. A method according to claim 1 whereby during the removal of the supporting members with the sheets lying thereon, the sheets are deposited in the correct position on said members by means of suitable shifting movements of the sheets against positioning stops provided on the supporting members.

11. A method according to claim 10 whereby the shifting movements are achieved by horizontal vibration of the supporting members.

12. A method according to claim 11 whereby during each vibration period, the supporting members are subjected to a slow shift in the direction corresponding to the desired shift of the sheet to be moved toward the positioning stops and a rapid shift in the opposite direction.

13. Apparatus for simultaneously separating at least one sheet from each of a plurality of stacks of sheets vertically spaced one above the other and removing the separated sheets into a desired position whereby at least one sheet is separated from each of said stacks at the same time, said apparatus comprising:

a frame comprising a plurality of vertical edge sections having upper ends mutually connected by transverse sections, a plurality of pick-up heads secured to said transverse sections for engaging the top sheet in the upper most of said stacks and thereafter separating said top sheet from said uppermost of said stacks, a plurality of horizontal tables mounted to said frame for vertical movement between said vertical sections, a plurality of pick-up heads secured to of said tables for engaging and separating sheets from each of the remainder of said stacks, a bottom horizontal table mounted to said frame for vertical movement between said vertical sections, and including pressure means secured to the underside of said bottom table for raising and lowering said tables, horizontal supporting means for the separated sheets, and means for inserting said supporting means between said set of pick-up heads and the immediately underlying stack and for removing said supporting means from between said pick-up heads and said stacks.

14. The apparatus of claim 13 wherein said supporting means includes apertures, and including means for bringing together the removed sheets and mutually connecting the removed sheets in superimposed position through said apertures.

15. The apparatus of claim 13 including:

stops on said supporting means, and positioning means for engaging the separated sheet on said supporting means and for pushing the separated sheet against said stops during the removal of said supporting means.

16. Apparatus according to claim 15 wherein the positioning means comprise brushes.

17. Apparatus according to claim 13 wherein the supporting means comprise positioning means in the form of horizontally vibrating vibration elements with adjustable amplitude, frequency, direction and vibration duration.

* * * * *